US005480349A

United States Patent [19]

Kolta

[11] Patent Number: 5,480,349

[45] Date of Patent: Jan. 2, 1996

[54] PAINT SPRAY BOOTH AIR SPEED CONTROL

[75] Inventor: Tibor Kolta, Dearborn, Mich.

[73] Assignee: Ford Motor Company, Dearborn, Mich.

[21] Appl. No.: 359,176

[22] Filed: Dec. 19, 1994

[51] Int. Cl.[6] ..... B05B 15/12

[52] U.S. Cl. ..... 454/52

[58] Field of Search ..... 118/326, DIG. 7; 454/50, 51, 52, 53, 54, 55

[56] References Cited

U.S. PATENT DOCUMENTS

| | | | |
|---|---|---|---|
| 3,035,507 | 5/1962 | Gresham . | |
| 3,168,029 | 2/1965 | Dock et al. . | |
| 3,168,030 | 2/1965 | Wilhelmsson et al. . | |
| 3,216,183 | 11/1965 | Larsson | 55/478 |
| 3,391,630 | 7/1968 | Wilhelmsson . | |
| 4,313,369 | 2/1982 | Tsuruta et al. . | |
| 4,515,072 | 5/1985 | Crisp . | |
| 4,537,120 | 8/1985 | Josefsson . | |
| 4,729,295 | 3/1988 | Osawa et al. . | |
| 4,926,746 | 5/1990 | Smith . | |
| 5,095,811 | 3/1992 | Shutil et al. | 454/53 |
| 5,133,690 | 7/1992 | Bowe | 454/51 |
| 5,173,118 | 12/1992 | Josefsson | 118/309 |

FOREIGN PATENT DOCUMENTS

| | | | |
|---|---|---|---|
| 3834109 | of 1990 | Germany | 454/52 |
| 8800724 | 10/1989 | Netherlands | 454/52 |
| 8802855 | 6/1990 | Netherlands | 454/52 |

*Primary Examiner*—Harold Joyce

*Attorney, Agent, or Firm*—Joseph W. Malleck; Roger L. May

[57] ABSTRACT

A paint spray booth including an air supply having a fan motor is controlled by first and second plenums and air restrictors that adjustably control the flow of air from the second plenum to first and second areas of the booth that require different velocities of airflow. A pressure sensor responsive to air in the second plenum controls the air supply to maintain constant pressure in the second plenum so that the speed of air in the first and second areas is adequately controlled.

11 Claims, 5 Drawing Sheets

PAINT SPRAY BOOTH AIR SPEED CONTROL

FIELD OF THE INVENTION

This invention is directed to vehicle paint spray booths, and more particularly relates to such booths in which air speed is individually controlled for different areas of the booth.

BACKGROUND OF THE INVENTION

Means of adjusting air speed in different areas of a paint spray booth have been devised in the past. According to U.S. Pat. No. 5,173,118 (Josefsson, filed May 20, 1991), air speed is controlled by ten perforated plates slidable laterally with respect to each other such that the size of perforations is adjusted.

According to U.S. Pat. No. 4,537,120 (Josefsson, filed Apr. 20, 1983), separate zones of a paint spray booth can have different air velocities circulating in them.

SUMMARY OF THE INVENTION

The invention can be used to advantage in a paint spray booth, including an air supply having a fan motor. The applicant has discovered an improved apparatus and method for controlling the speed of the air in a first area and a second area of the booth. A first plenum receives air under pressure from the air supply, and a second plenum receives air from the first plenum. A restrictor adjustably controls the flow of air from the second plenum to the first area, so that the speed of the air in the first area is adjusted. Another restrictor adjustably controls the flow of air from the second plenum to the second area, so that the speed of the air in the second area is adjusted. A pressure sensor responsive to the air in the second plenum is used to control the air supply to maintain a predetermined pressure in the second plenum. As a result, the speed of air in the first area and the speed of air in the second area is controlled to a degree unattainable by prior art apparatus or methods.

Additional features and advantages of the invention will be more apparent from the following detailed discussion of certain preferred embodiments.

BRIEF DESCRIPTION OF DRAWINGS

The detailed description of certain preferred embodiments of the invention is provided below with reference to the accompanying drawings, wherein the same reference numerals are used for a given feature in all figures.

DETAILED DESCRIPTION OF CERTAIN PREFERRED EMBODIMENTS

Figure 1:
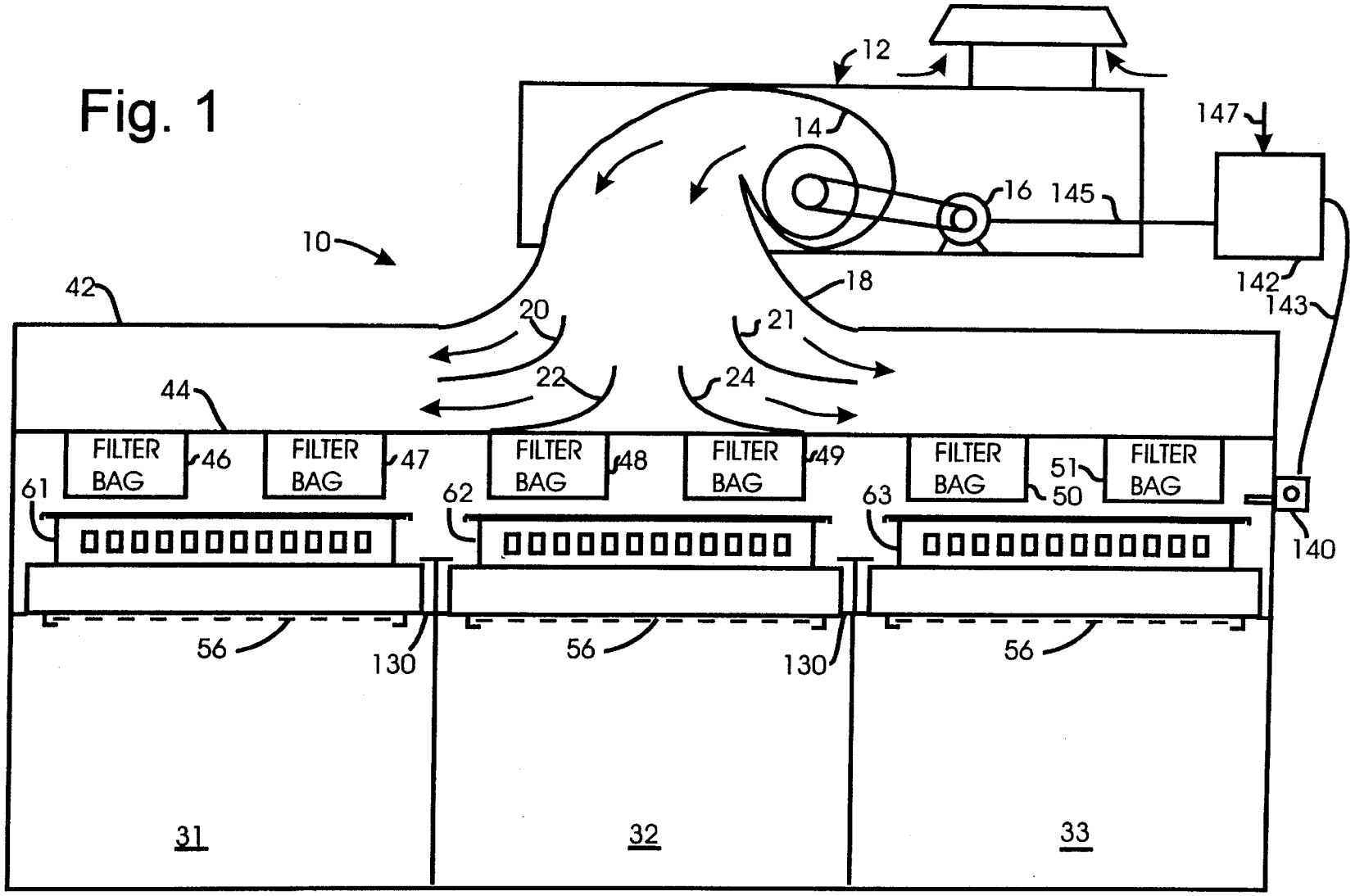
FIG. 1 is a schematic elevational view of the length of a paint spray booth made in accordance with a preferred mode of the present invention.
Figure 2:
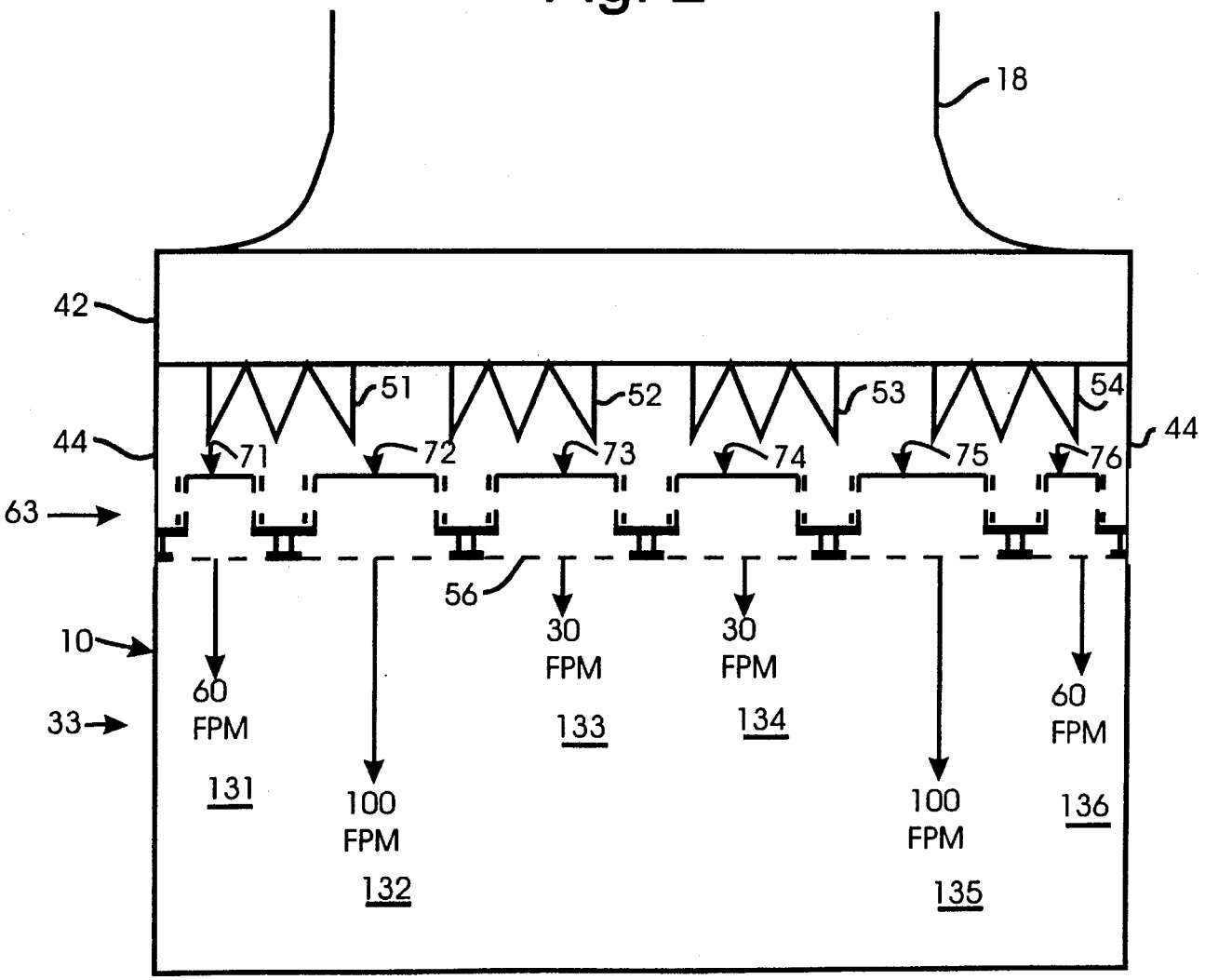
FIG. 2 is a schematic elevational view of the width of the paint spray booth shown in FIG. 1.

Referring to FIGS. 1 and 2, a paint spray booth 10 made in accordance with the preferred embodiment of the invention comprises an air supply 12 that incorporates a fan 14 driven by a conventional electric motor 16 which is speed controlled through a conductor 145 by a variable frequency drive 142 having a power supply conductor 147 and which receives through line 143 a control signal from a pressure sensor instrument 140 sensing the air pressure in a lower plenum 44. Air generated by fan 14 is conducted through a housing 18 and is distributed by baffles 20, 21, 22 and 24.

Booth 10 includes sections 31–33, but may include any number of additional sections fabricated in a similar manner. Each of these sections includes both an upper plenum 42 and a lower plenum 44 that are interconnected as shown through filter bags 46–54. Lower plenum 44 is connected to sections 31–33 by ceiling filters 56. A ceiling filter is mounted on the bottom of each box located in compartments 61–63. Each of these compartments consists of six boxes, such as boxes 71–76 indicated in FIG. 2, but each compartment can have more or fewer boxes.

Referring to FIG. 2, exemplary box compartment 63 includes air restrictor boxes 71–76 arranged as shown. Each of the boxes is identical except in width and may be understood from the following description of box 72.

Figure 3:
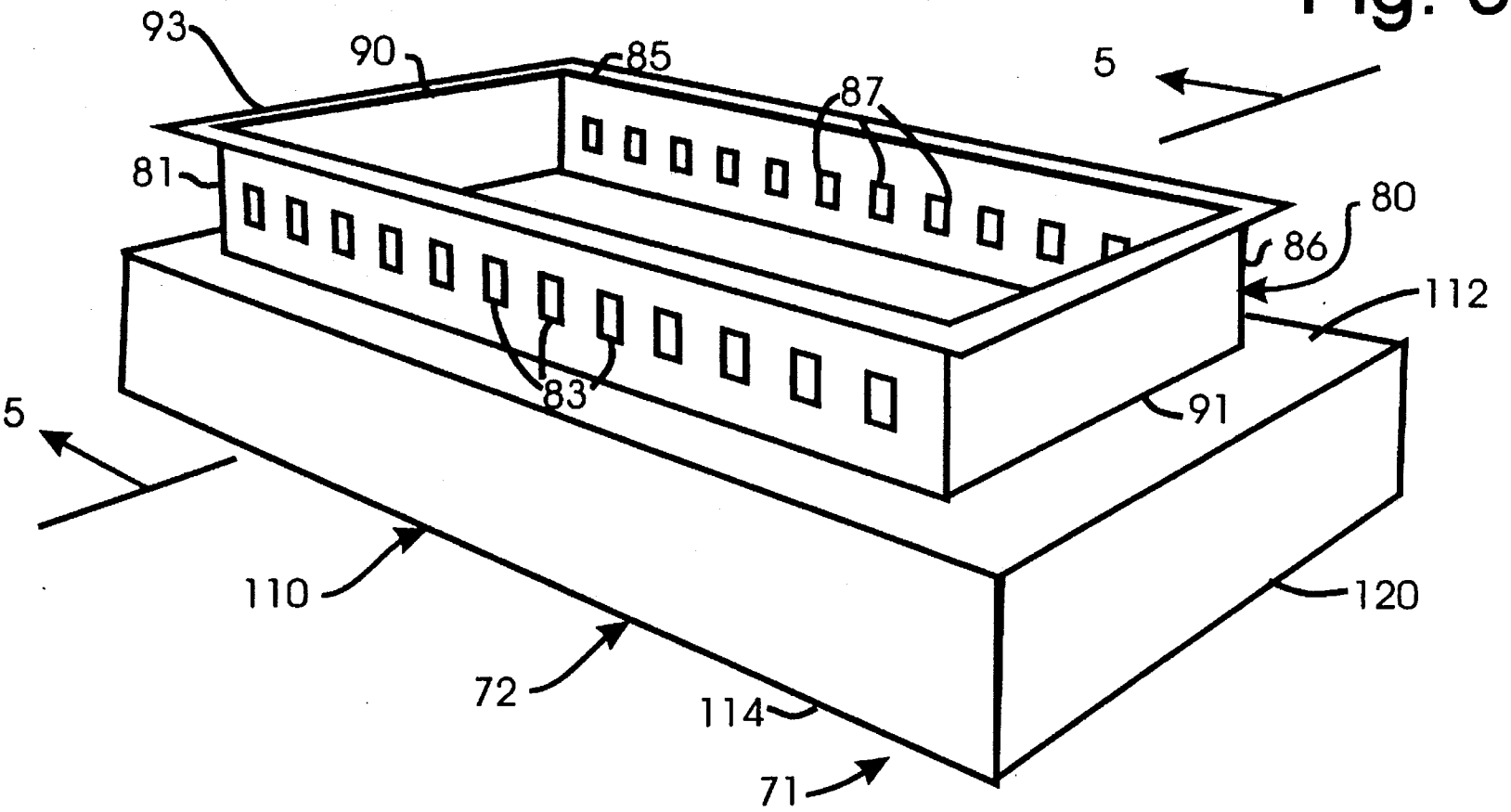
FIG. 3 is a perspective view of a box compartment made in accordance with the preferred mode of the present invention with the top cover removed.
Figure 4:
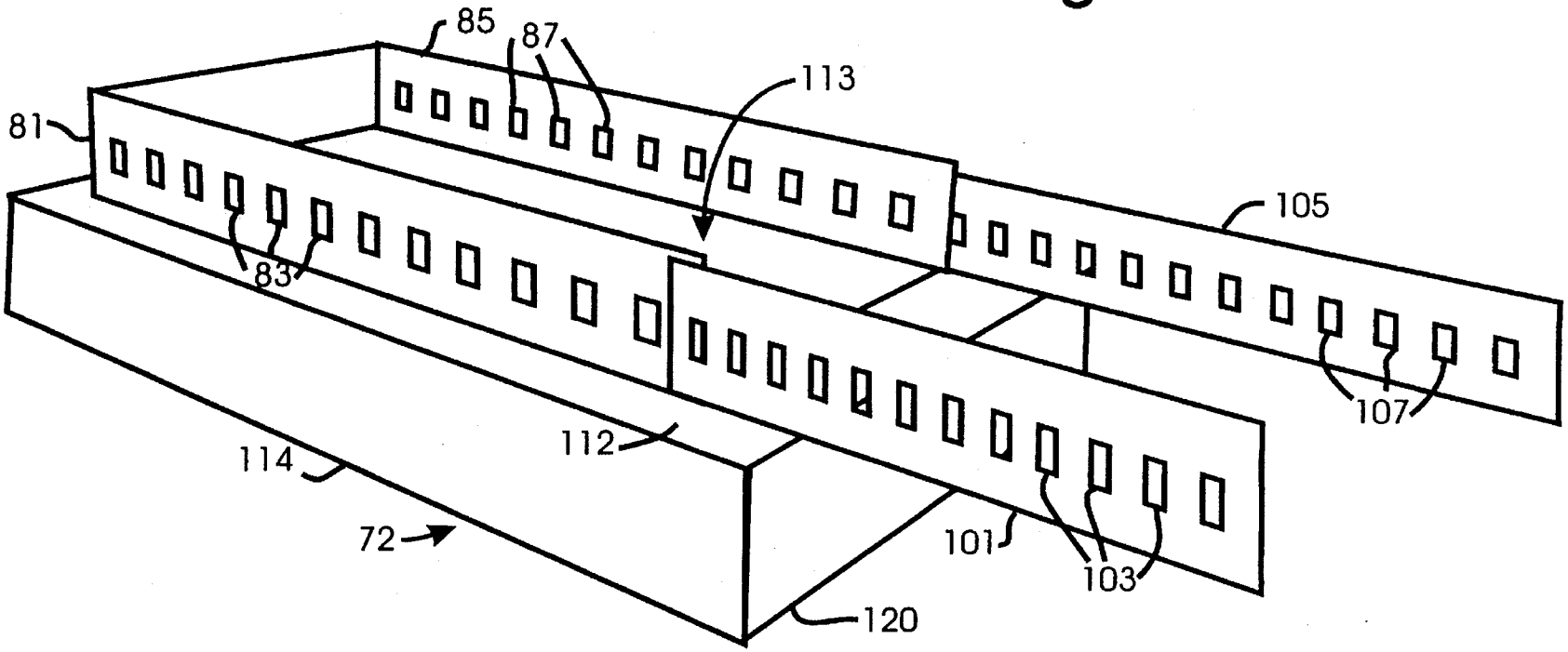
FIG. 4 is a perspective view of the box compartment shown in FIG. 3 with the top cover, the top of the box flange and the screens removed and with movable plates pulled forward for clarity from their normal position in respect to the set of holes of the box compartment.
Figure 5:
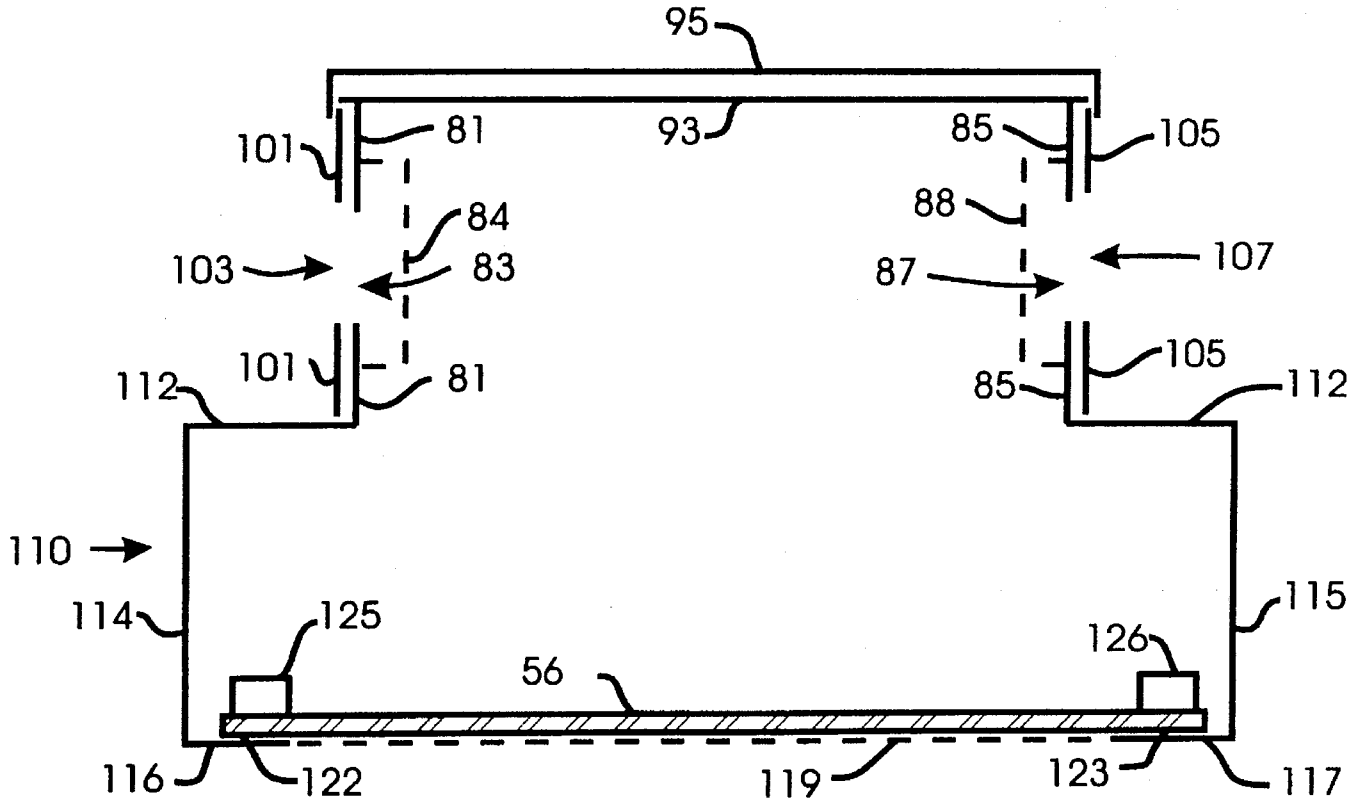
FIG. 5 is a schematic view taken along line 5—5 in FIG. 3 with the cover and top cover plate of the box installed.

Referring to FIGS. 3–5, box 72 comprises an upper box 80 having fixed side plates 81 and 85 defining a number of identical rectangular openings with their centers spaced equidistant apart. Exemplary openings are identified by the numbers 83 and 87. As shown in FIG. 5, plate 81 is fitted on the inside with an entry air screen 84 to slow down high velocity air entering through the holes into the box. As shown in FIG. 5, plate 85 with the holes 87 also is fitted on the inside with an air entry screen 88. The purpose of the screen is to slow down the high speed entering air. Box 72 also includes end plates 90 and 91, a top flange 93 and a removable cover 95. Cover 95 serves as a portion of the floor of plenum 44.

Referring to FIGS. 4 and 5, box 72 also includes two movable plates 101 and 105 defining identical rectangular holes having their center points spaced equidistant apart. Exemplary holes 103 and 107 are sized and spaced similar to holes 83 and 87, but are not located directly opposite one another.

Holes 103, if slid directly over holes 83, will give maximum airflow. By sliding plate 101 in a position to cover the holes 83, airflow through holes 83 is reduced practically to zero. The same principle applies to holes 87 and 107, and to plate 105.

Box 72 also includes a lower box 110 having horizontal upper flanges 112 that define a central opening 113. As shown in FIG. 5, box 110 also includes side panels 114 that define underturned flanges 116 that hold screen 119 on which booth ceiling filter 56 is supported.

Referring to FIGS. 3 and 4, box 110 also includes two end panels at the opposite ends of the box, including end panel 120.

Referring to FIG. 2, boxes 72–75, as well as two narrow boxes 71 and 76, enable air from plenum 44 to be individually adjusted so that the velocity of air moving downward in the zones 131–136 can be individually controlled. The air speed can be different in each box and each zone if so adjusted.

Dirt build up in some or all of the filters that separate plenum 42 from plenum 44 will not change the airflow, because fan 14 will automatically compensate to maintain the same air pressure in plenum 44 at all times during operation. The constant air pressure can be maintained as low as 0.2 inch water column. The velocities of air flowing in zones 131–136 can be maintained at an almost constant speed.

The air velocity in zones 131–136 can be controlled by manually moving the plates of the various boxes supplying the zone in question. For example, the holes in plates 101 and 105 (FIGS. 4 and 5) can be partially aligned with the openings in plates 81 and 85 in box 72 in order to restrict airflow from plenum 44 into zone 132 served by box 72. Referring to FIGS. 2 and 4, in order to adjust the air velocity in zone 132 under box 72 for 100 feet per minute, plate 101 is slid with respect to perforated holes 83 on plate 81 of the box until holes 103 partially overlap holes 83. Plates 85 and 105 on the other side of box 72 are adjusted in a similar manner. The sliding continues until the airflow from plenum 44 through openings 103 and 83 and through openings 87 and 107 into zone 132 is adequate for 100 feet per minute down speed. Air is prevented by baffles 130 from reaching areas 31–33 except through adjustable holes in air restrictor boxes, such as box 72.

The plates of boxes 71 and 73–76 can be adjusted in a similar manner to provide 60 feet per minute of airflow through zones 131 and 136 (FIG. 2), 100 feet per minute of airflow through zone 135, and 30 feet per minute of airflow through zones 133 and 134. As is well known in the art, varying the airflow through different zones of the paint booth reduces the concentration of paint vapors and simultaneously reduces the amount of air that needs to be cleaned from solvent vapors to reduce air pollution.

Placement of holes 83, 87, 103 and 107 in the upper box 80 is an important feature that prevents high velocity air from passing through localized spots of ceiling filter 56, thereby avoiding pockets of air with uneven speed from exiting different areas of filter 56 within box 72. Placement of the holes in the positions shown prevents air turbulence from reaching lower box 110, thereby obtaining an almost constant exit air velocity from filter 56 of box 72.

Filter 56 is compressed on its periphery in areas such as 122 and 123 by clamps shown schematically as 125 and 126 to prevent edge leaks from box 72.

The various preferred versions or embodiments of the invention described in detail above are intended only to be illustrative of the invention. Those skilled in the art will recognize that modifications, additions and substitutions can be made in the various features and elements of the invention without departing from the true scope and spirit of the invention. The following claims are intended to cover the true scope and spirit of the invention.

What is claimed is:

1. In a paint spray booth including an air supply having a fan motor, improved apparatus for controlling the speed of air in a first area and a second area of said booth comprising in combination:

a first plenum for receiving air under pressure from said air supply;

a second plenum for receiving air from said first plenum;

first restrictor means for adjustably controlling the flow of air from said second plenum to said first area so that the speed of the air in said first area is adjusted;

second restrictor means for adjustably controlling the flow of air from said second plenum to said second area so that the speed of the air in said second area is adjusted;

a pressure sensor response to the air in said second plenum; and control means responsive to said pressure sensor for controlling said air supply to maintain a controlled pressure in said second plenum, whereby the speed of air in said first area and the speed of air in said second area are controlled.

2. Apparatus, as claimed in claim 1, and further comprising filter means for filtering the air flowing from said first plenum to said second plenum.

3. Apparatus, as claimed in claim 1, wherein said first and second restrictor means each comprise a first plate defining adjustable air openings.

4. Apparatus, as claimed in claim 3, wherein said first and second restrictor means each further comprise a second plate defining holes that move with respect to said air openings to adjust the effective size of said air openings.

5. Apparatus, as claimed in claim 1, wherein said control means comprises means for adjusting the speed of said fan motor.

6. Apparatus, as claimed in claim 3, wherein said first and second restrictor means each comprises an upper box comprising said first plate and a lower box for transmitting air from said upper box to said first or second areas, whereby uneven air speed in said first and second areas is avoided.

7. In a paint spray booth including an air supply having a fan motor, an improved method of controlling the speed of air in a first area and a second area of said booth by using a first plenum and a second plenum comprising the steps of:

receiving air under pressure in said first plenum from said air supply;

receiving air in said second plenum from said first plenum;

adjustably controlling the flow of air from said second plenum to said first area so that the speed of the air in said first area is adjusted;

adjustably controlling the flow of air from said second plenum to said second area so that the speed of the air in said second area is adjusted;

sensing the air pressure in said second plenum; and controlling said air supply in response to said sensing of said air pressure to maintain a controlled pressure in said second plenum, whereby the speed of air in said first area and the speed of air in said second area are controlled.

8. A method, as claimed in claim 7, and further comprising the step of filtering the air flowing from said first plenum to said second plenum.

9. A method, as claimed in claim 7, wherein said step of adjustably controlling the flow of air from said second plenum to said first area comprises the step of varying the size of air openings between said second plenum and said first area.

10. A method, as claimed in claim 7, wherein said step of adjustably controlling the flow of air from said second plenum to said second area comprises the step of varying the size of air openings between said second plenum and said second area.

11. A method, as claimed in claim 7, wherein said step of controlling said air supply comprises the step of adjusting the speed of said fan motor.

* * * * *